US011293171B2

(12) United States Patent
Berry

(10) Patent No.: US 11,293,171 B2
(45) **Date of Patent: *Apr. 5, 2022**

(54) FILTERING DRAIN COVER

(71) Applicant: Steven Berry, Ashburn, VA (US)

(72) Inventor: Steven Berry, Ashburn, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/086,338

(22) Filed: Oct. 31, 2020

(65) Prior Publication Data

US 2021/0047817 A1 Feb. 18, 2021

Related U.S. Application Data

(63) Continuation-in-part of application No. 16/431,836, filed on Jun. 14, 2019, now Pat. No. 10,822,785.

(51) Int. Cl.

| | |
|---|---|
| ***E03F 5/06*** | (2006.01) |
| ***E03C 1/264*** | (2006.01) |
| ***E03F 5/04*** | (2006.01) |
| ***E04D 13/04*** | (2006.01) |

(52) U.S. Cl.

CPC ..... *E03C 1/264* (2013.01); *E03F 5/041* (2013.01); *E03F 5/0407* (2013.01); *E03F 5/06* (2013.01); *E04D 13/0409* (2013.01)

(58) Field of Classification Search

CPC ..... E03F 5/0404; E03F 5/0407; E03F 5/041; E03F 5/06; E04D 13/0409; E04D 2013/0413

USPC ..... 210/163, 164, 165, 166, 170.03, 335

See application file for complete search history.

(56) References Cited

U.S. PATENT DOCUMENTS

| | | | | | |
|---|---|---|---|---|---|
| 853,598 | A * | 5/1907 | Rile | E04D 13/0409 | 210/166 |
| 1,762,838 | A * | 6/1930 | Shand | E04D 13/0409 | 210/166 |
| 4,035,297 | A * | 7/1977 | Aldridge | E04D 13/0409 | 210/163 |
| 4,658,449 | A * | 4/1987 | Martin | E04H 4/1236 | 210/163 |
| 5,575,903 | A * | 11/1996 | Kato | E04D 13/0409 | 210/164 |
| 7,300,573 | B1 * | 11/2007 | Trangsrud | E03F 5/0404 | 210/163 |
| 10,822,785 | B1 * | 11/2020 | Berry | E03F 5/0407 | |

(Continued)

FOREIGN PATENT DOCUMENTS

EP 1041217 * 10/2000

*Primary Examiner* — Christopher Upton

(57) ABSTRACT

A two-stage filtering drain cover that can be retrofitted to an existing, original construction, areaway drain cover. The filtering drain cover of the invention inhibits the accumulation of debris on the existing drain cover, and passage of debris into the drain, and helps to prevent clogs and flooding. The outer cover member of the device is configured with passages that permit liquid flow through the outer cover while filtering larger size debris particles that may be entrained in the passing liquid. A perimeter wall on the outer cover and with similar liquid flow passages stops larger debris from passing the outer cover. An inner filter member fits within the outer cover and is configured with relatively smaller passages to obstruct smaller sized debris that may have penetrated the outer cover from passing into the drain.

18 Claims, 7 Drawing Sheets

(56) References Cited

U.S. PATENT DOCUMENTS

2016/0040409 A1* 2/2016 Powers ..... E03C 1/264
210/164

* cited by examiner

FILTERING DRAIN COVER

CROSS REFERENCE TO RELATED APPLICATION

This application is a continuation-in-part of copending application Ser. No. 16/431,836 that was filed on Jun. 5, 2019 the disclosure of which is hereby incorporated by reference.

FIELD OF THE INVENTION

The present invention relates to common floor drains, residential walkout basement stairwell drains, and similar pipe drains, commonly fitted with a perforated cover intended to keep local debris entrained in the passing liquid from entering the drainpipe, and which are known to be prone to clogging in the presence of this debris.

BACKGROUND OF THE INVENTION

Pipe drains and floor drains are very common in commercial and residential construction, and are effective to evacuate rain and other water and liquid sources from undesirable and sometimes damaging pooling, and, in worst cases, flooding into buildings or homes. Perforated or slotted, flat, drain covers are often a feature at the ground level, floor level, or roof level entrance to these drains to keep local debris that has been swept up in draining liquids from entering the drainpipe. Unfortunately, entrained debris can collect on the surface and in the immediate vicinity of the flat drain cover. Smaller debris that passes through the flat drain cover can clog the drain line internally. Either situation can lead to pooled liquids, such as rainwater, that can lead to pedestrian inconvenience and potentially damage to the adjacent building and property.

Various inventions have been introduced to avoid this kind of pipe drain clogging, usually by elaborations of the original construction pipe drain or pipe drain cover design. Examples include U.S. Pat. No. 4,419,232 which involves filtering components that trap debris after passing through the drain cover. This type of design requires additional components below the surface of the drain cover. Such features mean that the cover must be geometrically compatible with the original pipe and its installation details and must be removed to gain access to the filtering elements for cleaning or replacement. U.S. Pat. No. 1,791,512 describes a two-stage roof drain, but does not ensure that all liquid must pass through both filtration stages. Additionally, a significant portion of the first filtration stage is not removable for cleaning. U.S. Pat. Nos. 1,762,838; 3,529,723; and 4,525,273 have similar embodiments and are similarly limited in their installation and use for the same reasons.

Other designs have been introduced intended as supplemental devices to inhibit the clogging of original construction drain covers. U.S. Pat. No. 4,658,449 describes a swimming pool drain cover apparatus that is to be positioned over the existing drain with a somewhat dome-shaped armature structure covered with a mesh material to filter debris. Similarly, U.S. Pat. Nos. 7,005,061 B1 and 8,679,328 B2 involve a mesh material covering to be positioned over an existing drain. These devices offer only a single layer of additional filtering protection more than the perforated original construction cover. Because they are built with a rigid construction material and even a rigid structural frame to support the filtering mesh, they cannot conform to uneven surfaces. Debris can pass into the drain between the device and the mounting surface in areas where the device does not conform precisely to the shape of the mounting surface, e.g., where construction imperfections may exist such as waviness of a hand-worked surface in the vicinity of the drain. This loss of sealing would be especially evident in generally square-shaped designs (as viewed from above) in the case of a typical, conical sloping, contour formed in the drain cover mounting surface so as to direct the flow of water toward the drain.

U.S. Pat. No. 8,557,109 B1 describes a vertically-oriented, annular ring with holes to restrict the flow of debris into an open drain. This design also offers only this single vertical layer of protection with passages sized to obstruct only larger debris but allowing significant quantities of smaller debris to enter the drain. Moreover, the open top in some embodiments offers no defense from debris falling directly into the drain, such as leaves falling or blown from nearby trees.

Finally, U.S. Pat. No. 9,573,086 B2 describes a flexible rubber-like mat to cover an existing drain with vertically-oriented perforations passing through the mat to pass liquid and protrusions on the bottom surface to permit passage of liquid along the underside of the mat. This device still has the limitation of a single filtration layer and generally lacks the height necessary to "wall-off" debris as it encounters the device.

It would be desirable to have a pipe drain cover that would inhibit the passage of debris through the cover and thereby protect the covered drainpipe from clogging with debris.

It would also be beneficial to provide a drain grate cover that could be used on floor drains despite variations in design or installation details.

It would be helpful to have a floor drain grate that could be used effectively on floor drains that have uneven adjacent surfaces.

SUMMARY OF THE INVENTION

It is an object of the invention to provide for a two-stage floor drain cover that fits over an existing flat drain cover and provides enhanced protection against debris clogs.

It is further an object of the invention to supply a floor drain grate that prevents clogging on floor drains despite variations in design or installation details.

Yet another object of the invention is to provide greater liquid pass-through openings surface area than, and also additive to, the existing drain surface area, which increases the amount of debris required to block individual liquid passage openings before flow becomes restricted or impeded altogether.

A further object of the invention is an effective floor drain cover that obstructs the flow of debris from impinging upon an existing drain cover despite a non-flat condition or other imperfections in the drain cover mounting surfaces that would otherwise leave gaps and permit local debris to pass into the drain.

An additional object of the invention is a floor drain cover that can be easily removed from its normal working position over an existing drain cover without any tools or undue manipulation and that can be easily disassembled to facilitate cleaning and/or removal of trapped debris.

A preferred object of the invention is a floor drain cover that maintains its physical location over the existing drain even when subject to the dislodging forces of flowing water, wind, or physical contact from persons walking near the drain.

It is especially an object of the invention to inhibit clogging of a floor drain, most typically a pipe drain in a walkout basement stairwell or similar, so as to avoid flooding of water into the basement.

In accordance with these and other objects of the invention that will become apparent from the description herein, a floor drain grate cover according to the invention comprises: a first stage having liquid passages of a first size sufficient to block larger debris having at least one dimension greater than said first size, and a second stage having liquid passages of a second size sufficient to block smaller debris that has at least one dimension greater than said second size and that passed through the first stage liquid passages. This is a multistage device, having a domed, outer shell of hard, semi-hard, or flexible material that keeps out the bigger pieces of debris (leaves, grass clippings, . . . ), and a substantially flat, internal, more flexible strainer to filter the smaller debris that passes through the outer shell while still allowing filtered water to flow into the floor drain below the cover. The two-piece filter cover of the present invention is user separable to facilitate occasional cleaning and is readily placed into position over the existing drain and allowed to rest its perimeter edges on the surrounding concrete. A vertical post formed on the inside of the outer cover can be used to mechanically link the outer cover to the inner filter so they are installed and removed together. A somewhat longer post can also extend down into an opening in the pre-existing, flat, floor grate and help to secure the elevated cover from becoming dislodged.

Floor drain covers according to the invention are readily deployed over a wide variety of drains, especially outdoor floor drains that are exposed to a wide variety of potentially clogging backyard debris including leaves, twigs, pebbles, grass, and various plant clippings. The drain cover of the invention reliably remains in place and selectively filters debris to maintain effective drainage through the in-ground drain while also allowing tool-free removal for cleaning.

BRIEF DESCRIPTION OF THE DRAWINGS

Note: The same structure or feature is identified with the same reference number in all figures.

DETAILED DESCRIPTION

Figure 1:
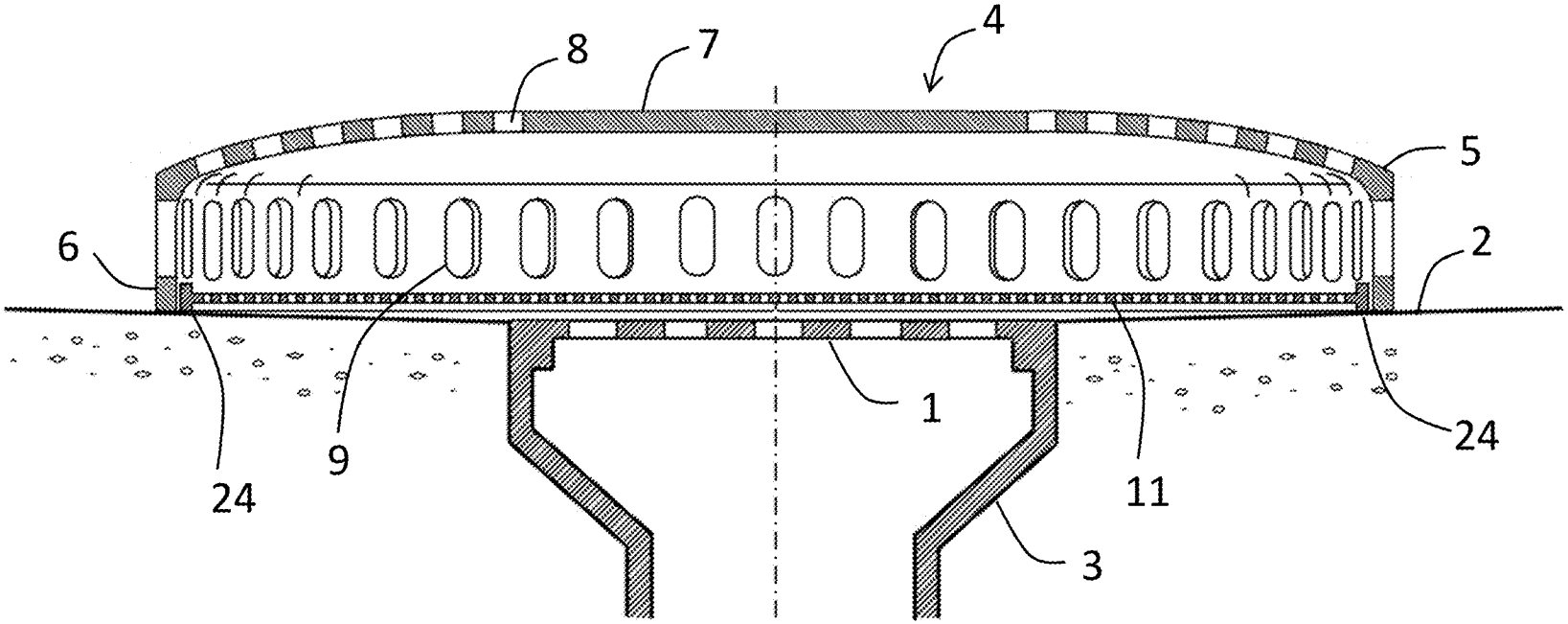
FIG. 1 is a section view of the first, outer filtering member showing the slotted, cylindrical, vertical wall and the upper slotted horizontal plane that closes off the upper end of the cylinder. Also shown is the perforated or meshed second, inner filtering member with peripheral rim, positioned over the existing drain cover.

The present invention is conveniently described with reference to a cylindrical drain cover although it will be understood that the drain cover can be of virtually any geometric shape, e.g., square, pentagonal, hexagonal, etc.

Drain covers according to the invention include an outer filtering cover and an inner filter that serves as a second stage of filtering. The outer filtering cover is dimensioned to fit over and entirely cover or enclose an existing floor drain that is usually installed with a generally flat, perforated, metal cover grate having fairly large holes that grossly prevent larger debris, e.g., pebbles of 0.375 inches in size or larger from passing into the drain line but which allow smaller objects, e.g., seeds, grass clippings, broken leaves, seeds, seed pods, etc. to pass without substantial hindrance. Over time, these passed items can accumulate and also degrade the performance of the drain.

The two-part, elevated, filtering, drain cover of the present invention fits over the existing drain and allows water to pass but blocks most, if not substantially all, of the small yard debris, e.g., leaves, twigs, pebbles less than 0.25 inches in size, grass clippings, and similar debris that would likely pass through the openings in the flat grate and accumulate so as to clog the drain.

The first stage of the elevated drain cover of the invention has an outer cover that is dimensioned to at least fit over and entirely cover the existing flat floor drain grate such that the flat floor drain grate is fully enclosed within the area of contact between the contact perimeter of the cover and the underlying surrounding surface. In many instances this support surface will be made from cement or asphalt but may also be made of any other material surrounding the installed drain, e.g., wood, crushed stone, waterproofed surfaces, etc.

The first stage outer cover also has at least one upstanding perimeter wall that is capped by a dome-shaped top. This perimeter wall preferably rests on the support surface that surrounds the installed drain. Each of the perimeter wall and the dome-shaped top have first liquid passage openings of a first size dimension, e.g., from 0.125-0.25 inches, that substantially block passage of solid debris having a dimension larger than that first size. These first openings thus act as a first filtration stage for water heading to the drain.

The second stage has an inner, flexible, filter member that is dimensioned to fit entirely over the existing flat drain grate and yet also fit within the upstanding perimeter wall of the outer first stage cover. This inner filter member has second liquid passages of a second size dimension, e.g., from 0.0625-0.125 inches, that substantially block passage of solid debris having a dimension that is smaller than the first size openings in the outer cover and that have passed through the first liquid passage openings. This inner membrane performs a second filtering effect to further remove clogging debris from the draining water.

The elevated drain cover of the invention is conveniently installed as a retrofit product with or without mechanical connection to the existing flat drain grate. The cover is dimensioned to completely cover and enclose the existing flat grate and preferably also the outer perimeter of the grate fitting that serves as the opening for the drain pipe by contact with the support surface that surrounds the drain and flat grate cover.

The drain cover conveniently sits on the supporting surface that typically surrounds a conventional outdoor floor drain. In one embodiment of the invention, the elevated drain cover of the invention can be merely placed over the existing drain and grate. In another embodiment, one or more pin or other retention barbs extend from the bottom of the elevated cover first or second stage filters and fit into an opening in the flat drain grate so as to removably secure the elevated drain cover to the flat grate to better resist the dislodging forces of running water, wind, and inadvertent contact with the feet of passersby.

In some cases, large volumes of draining water may pool next to an elevated cover and hinder the ability of that cover to drain the pooled water. One embodiment of the elevated drain cover of the invention includes an inner filter member with a flexible outer rim that exhibits a plurality of weep holes around the underside of the rim. These weep holes are small enough and are on the inside of the outer cover so that they will continue to pass water coming under the small gaps between the perimeter of the outer first stage and the underlying support surface but not provide enough space for even the debris that would be caught on the second openings of the inner filter member. In other words, the weep holes in the outer rim of the second stage filter represent a third opening size dimension, e.g., less than 0.0625 inches, that is even smaller than the second opening size. At these size dimensions, water will slowly weep through the openings toward the drain and drain any water pooled against the elevated drain cover.

The outer first stage filter and the inner second stage filter can be loosely associated in a nesting relationship or they can be interconnected in a way that allows both elements to be removed together for cleaning. One way to interconnect the first and second stages is with a frictional fit between the outer perimeter of the inner filter element (2nd stage) against the inner perimeter of the outer cover (first stage). Another way is a mechanical interconnection such as a centrally-located, vertical post that extends down from the inside of the 1st stage top to connect with a centrally-located hub on the second stage so that said inner filter member and said outer cover are mechanically linked together via that post.

Figure 3:
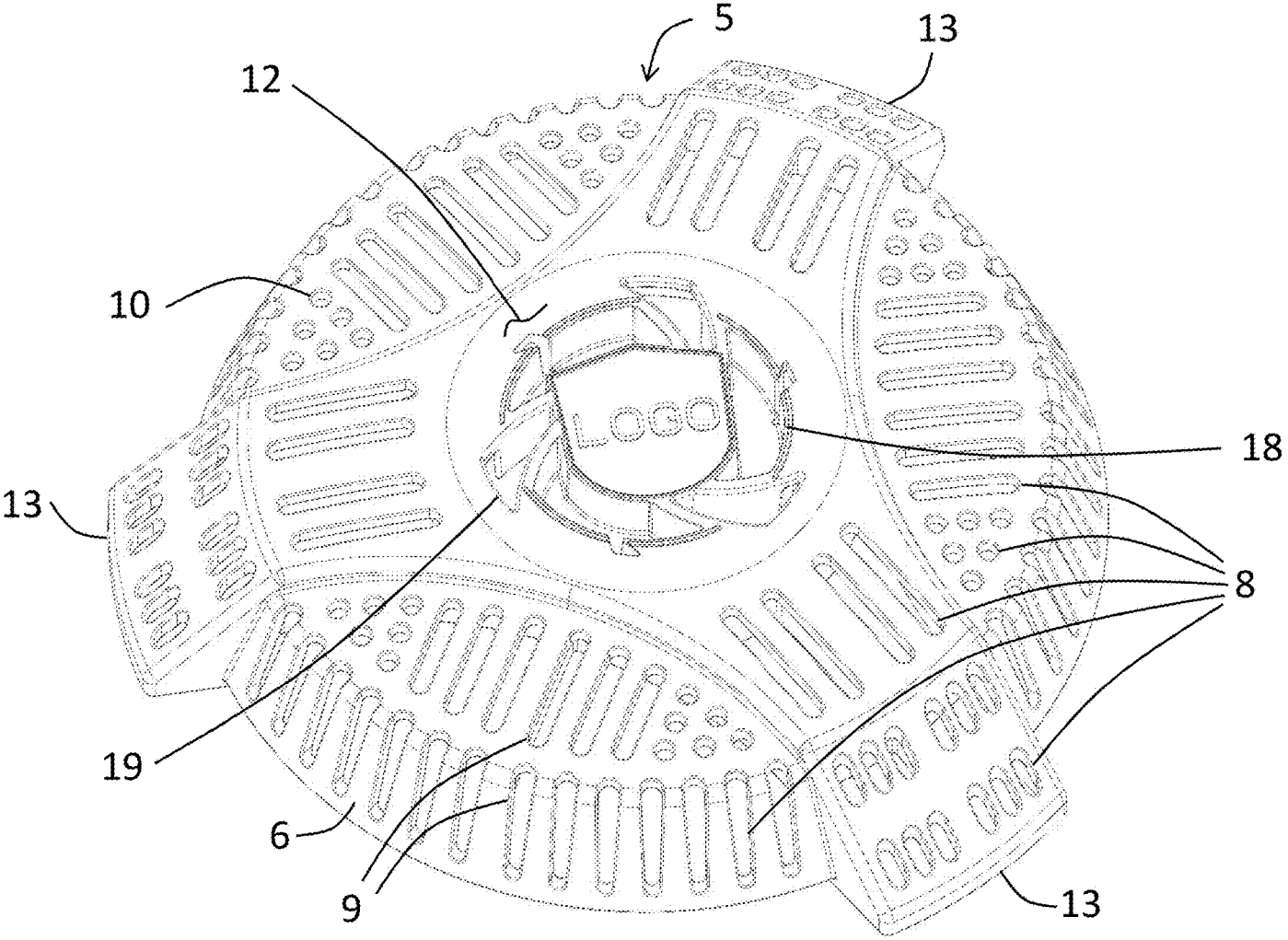
FIG. 3 shows a top view of an alternative design of the first filtering member, with outwardly slanted side walls, and slots and depressions for picking up the device.

As shown in the figures, pre-existing drain plate 1 is surrounded by drain cover mounting surface 2 and passes water into drain 3. Filtering drain grate 4 includes an outer filtering cover 5 that rises upwardly from drain cover mounting surface 2 by outer wall 6 that extends around the entire perimeter of filtering cover 5. As shown, outer wall 6 is generally vertical and rises substantially perpendicular to mounting surface 2. If desired, outer wall 6 can be sloped at an acute angle as shown in FIG. 3, preferably an angle within the range of 25-65°, to reduce the consequences of a passerby whose footfall contacts outer wall 6. Dome-shaped top 7 is integrally formed with outer wall 6.

Outer filtering cover 5 includes outwardly-slanted outer wall 6 and domed top 7 have a plurality of first openings 8, such as first slots 9 and/or first holes 10 that are sized to permit the passage of the draining liquid (e.g., rainwater or snow melt if outdoors) for which the existing drain 3 was installed. Debris that may be entrained in the draining liquid and that is above the size of the smallest opening 8 in outer cover 5 are blocked by outer cover 5. First slots 9 on outer wall 6 are preferably oriented away from the plane of mounting surface 2, e.g., such as vertically-oriented slots. A vertical orientation can more effectively block debris that would float or become entrained in a horizontal orientation that is substantially parallel to mounting surface 2 in water flowing towards outer wall 6. Smaller debris that are able to pass through are filtered from the drain water by inner filter 11.

Figure 2:
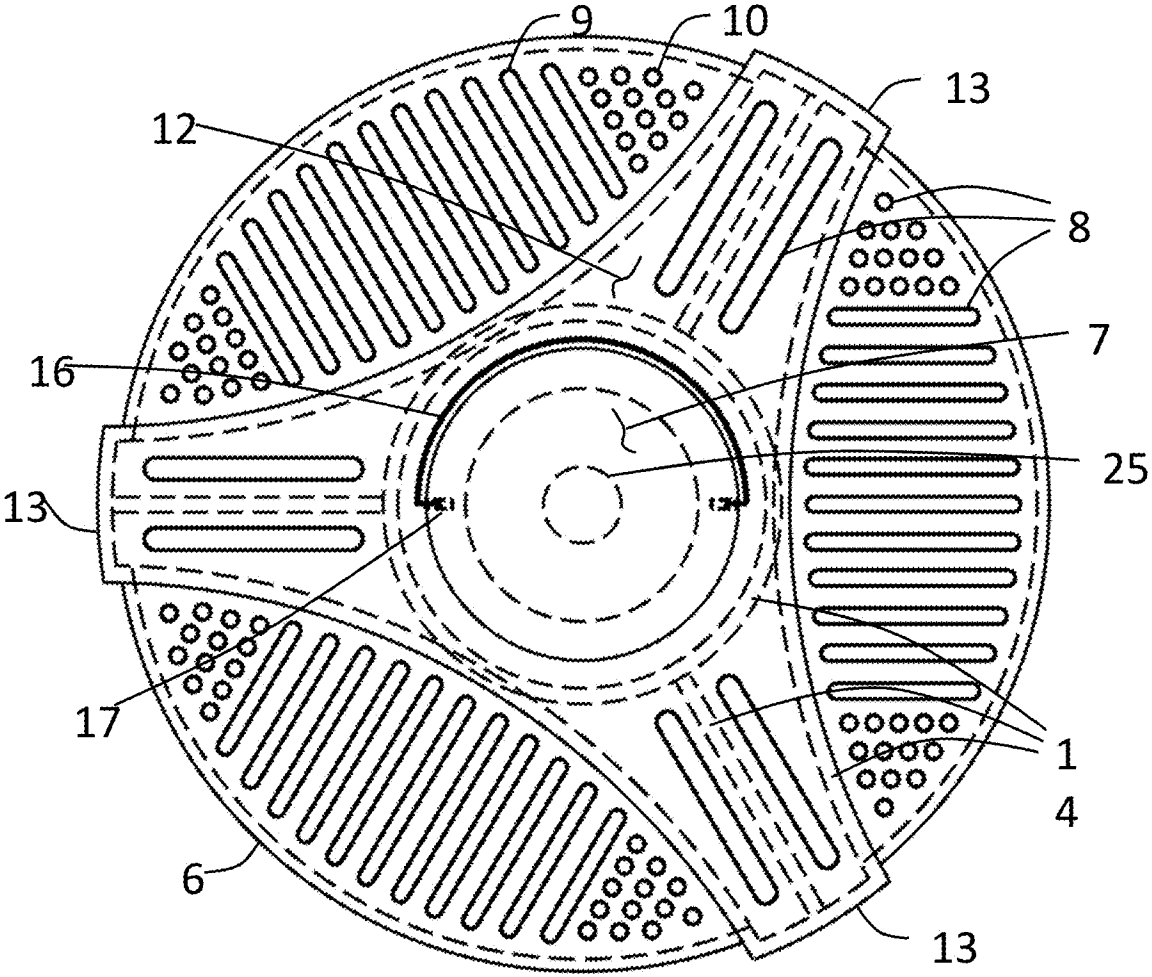
FIG. 2 shows the top view of the first filtering member, including a three lobed support bridge configuration to avoid hyper-static contact with the drain cover mounting surface. Also shown in hidden lines are reinforcing ribs. A handle to facilitate handling is also shown.

Another embodiment of the invention is shown in FIG. 2 and provides for a geometric design of the outer cover 5 that includes a three lobe support bridge 12 terminating in support feet 13. Support feet 13 are the contact areas between the outer cover 5 and drain cover mounting surface 2. These three support areas provide lateral stability to outer cover 5.

A series of supporting ribs 14 formed into bottom side 15 of outer cover 5. Ribs 14 enhance the structural rigidity of outer cover and help to resist excessive flexing or fracture of outer cover 5 when downward forces act on top 7 such as when a person accidentally steps or stands on outer cover 5.

On top 7 of outer cover 5 is a folding handle 16 that engages handle holes 17. Handle 16 generally lays flat on top 7 but can be unfolded to lift outer cover 5 off drain mounting surface 2 for cleaning without the need for tools and to avoid placing hands into debris that has accumulated around outer cover 5.

Alternative structures can also be used in lieu of a folding handle. For example, depressions 18 or slots 19 as shown in FIG. 3 can be formed into the upper surface of top 7 with a width and depth suitable for at least an average human forefinger. Preferably, a ridge is formed in top 7 that can be pinched between thumb and forefinger.

Inner filter 11 also includes a plurality of second openings 21, such as second round holes 22 and perimeter passages 23. Second openings 21 are generally of smaller dimensions than first openings 8, although not necessarily a smaller number of such second openings, so as to act as a finer screen against debris passing with draining liquid towards drain 3.

Because peripheral rim 24 of the inner filter 11 rests upon drain cover mounting surface 2, any liquids passing through or under outer cover 5 must then pass through second openings 21 in the inner filter 11 before reaching drain 3. The dual stage filtering effects of the present invention act to remove debris that would otherwise clog drain 3 and thereby help to maintain continued, effective, drain operation.

In general, the number of first openings 8 and second openings 21 should be as high as practicable both to maximize the potential surface area of filtering flow and to increase the number of passages that can be compromised by debris before flow falls to undesirable levels.

Figure 7:
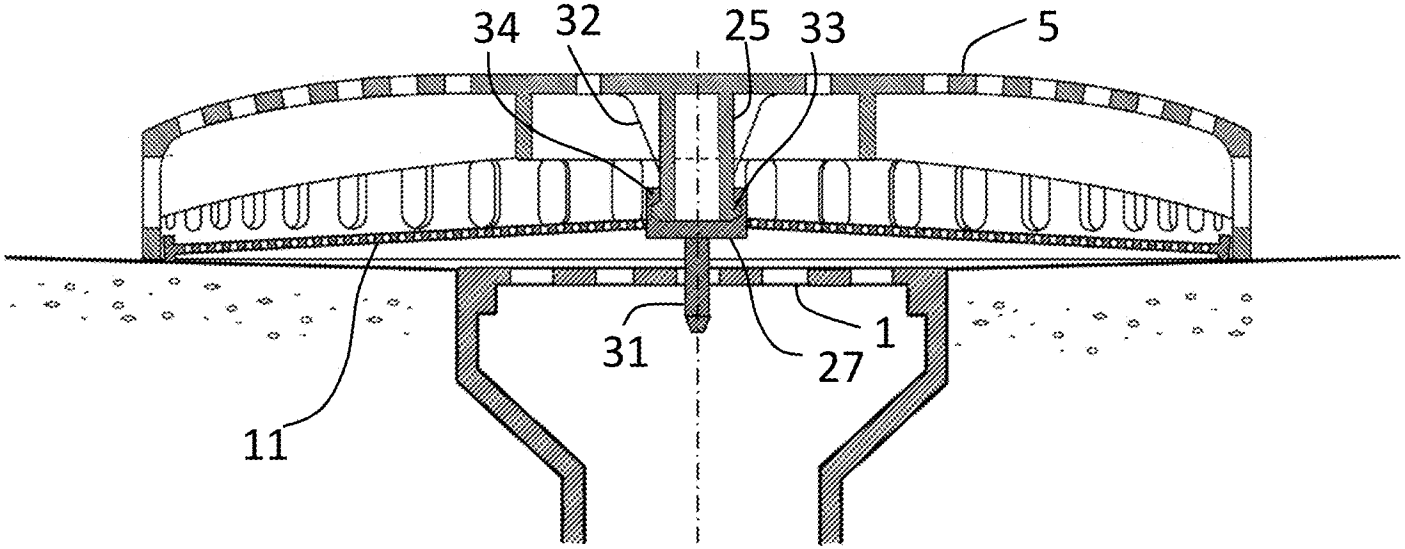
FIG. 7 shows a guide pin that removably engages the first and second filtering members of the invention to a pre-existing flat drain plate cover to restrict lateral movement.

An embodiment of the inner filtering member 11 comprises a vertical retention pin 31 that extends downwardly from the bottom of the second filtering member so that the pin can be inserted into an opening of an existing, flat drain plate 1 that is often provided with the original installation. This pin 31 holds the drain grate cover of the invention in place against the dislodging forces of rainwater and the occasional mis-step that could kick the grate cover out of position. This feature is shown in FIG. 7 in which inner filter 11 is disposed below outer drain cover 5 and wholly within its outer wall 6. Preferably, inner filter 11 is also cylindrical and dimensioned to fit wholly within outer cover 5, preferably by a friction or press fit against inside surface 26 of outer wall 6 so that lifting outer cover 5 also lifts inner filter 11 due to the above-described friction fit. A centrally located post 25 that extends down towards pre-existing drain cover 1 from outer cover 5 through inner filter 11 can be provided with dimensions to achieve this friction fit with a center hub 27.

As described, the present invention includes two stages of filtration, but similar geometrical arrangements could provide for three or more stages, and are considered within the scope of the present invention.

Another embodiment of the invention uses a flexible material for the peripheral rim 24 or the entirety of the inner filter 11. The flexible or semi-flexible properties of the material will permit outer rim 24 to conform to imperfections in the drain cover mounting surface 2 so as to avoid unintended gaps between peripheral rim 24 and drain cover mounting surface 2 that would otherwise undesirably permit draining water and entrained debris to pass between peripheral rim 24 and mounting surface 2.

Figure 4:
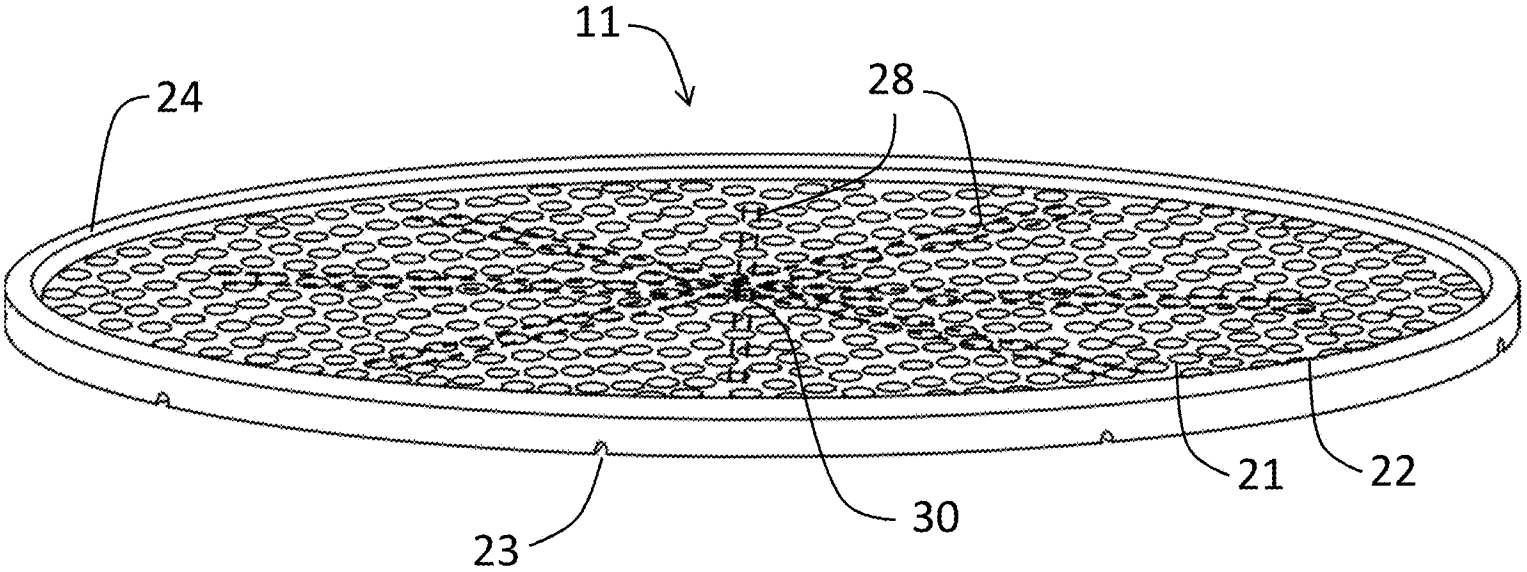
FIG. 4 is an isometric view of the second, inner filtering member, including radial supports and weep-down passages.
Figure 5:
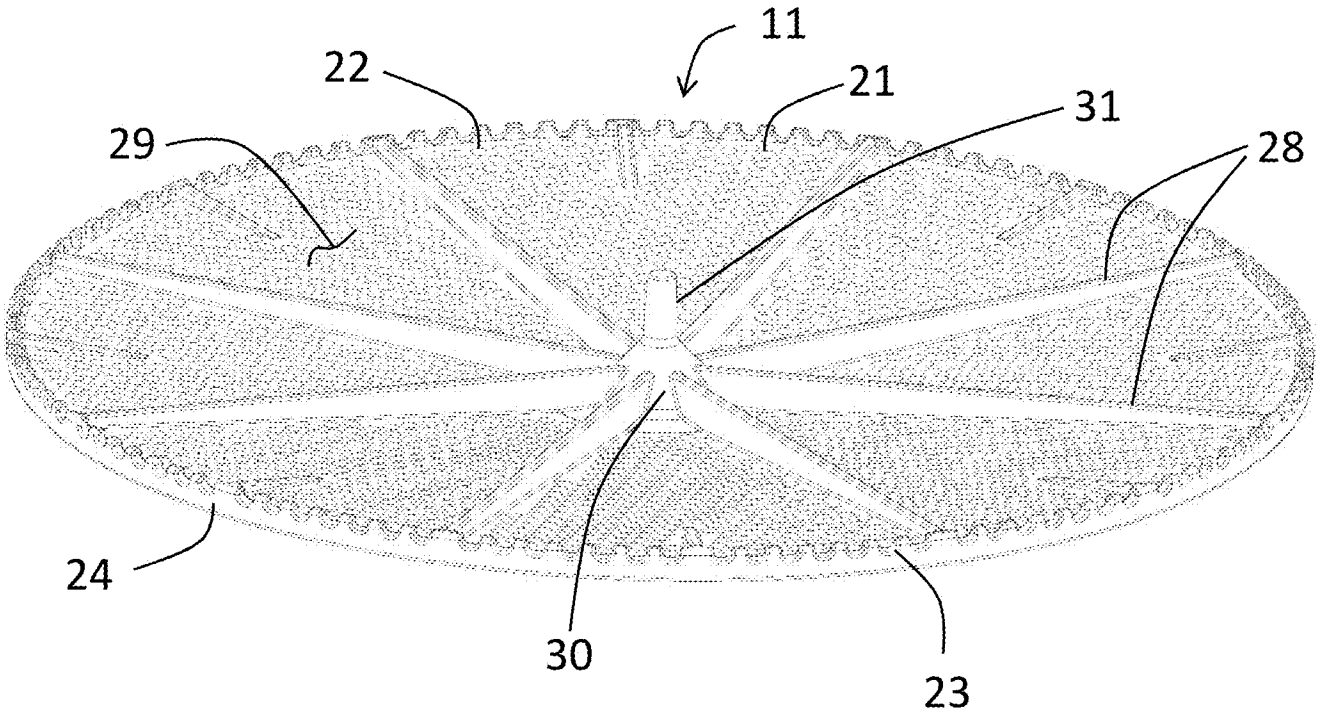
FIG. 5 shows an isometric view of the underside of an alternative design of the inner filtering member, with radial ribs that span the entire distance from center to outer perimeter.
Figure 6:
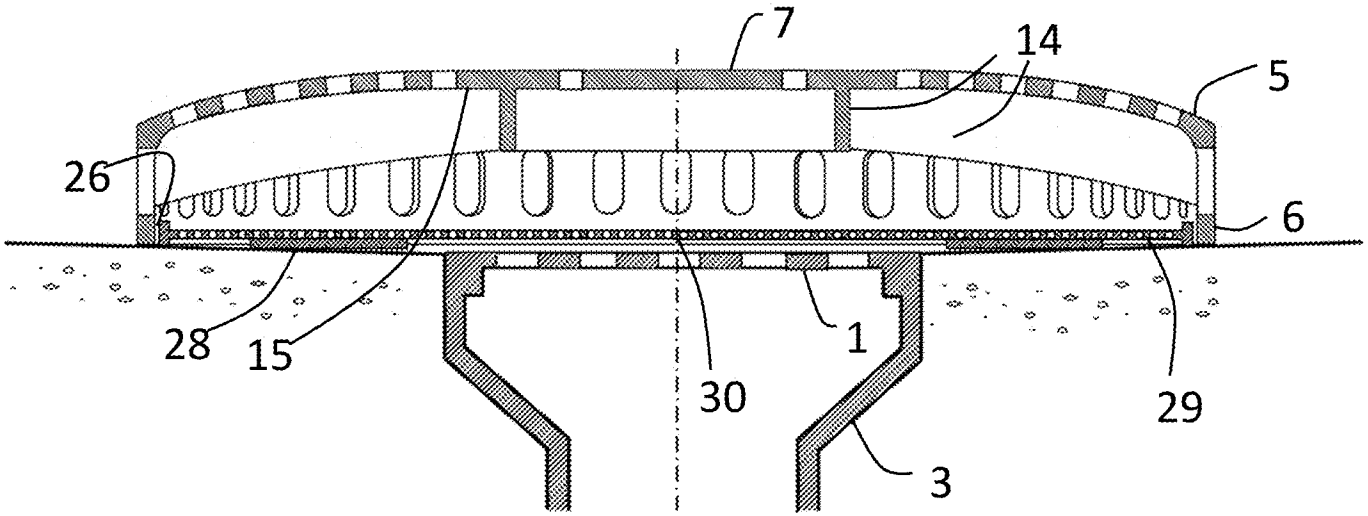
FIG. 6 is another section view of the complete device, showing reinforcing ribs for the first filtering member, and radial supports on the underside of the second filtering member.

A flexible inner filter 11 may benefit from the use of 2-10, preferably 4-8, radially extending ribs 28 on the underside of inner filter 11 to overcome flow blockage due to sagging of inner member filtering surface 29. Ribs 28 hold the filtering surface 29 away from drain mounting surface 2 and/or preexisting drain cover 1, maintaining a gap between them without which liquid flow toward the drain may be inhibited. Ribs 28 may or may not extend across the entire distance from the center of filtering surface 29 to rim 24 and may be segmented or simply vertical protrusions. As shown in FIGS. 4 and 6, ribs 28 do not extend across the entire distance of filtering surface 29. FIG. 4 shows ribs 28 that extend from center 30 for a distance of about 60-75% of the radius of inner filter 11. FIG. 6 shows ribs 28 beginning at a distance from center 30 and extending about for a distance of about 25-40% of the radius of inner filter 11. FIG. 5 shows ribs 28 that span the entire distance from center 30 to the outer rim 24.

Small weep holes 23 on the underside of peripheral rim 24 can be used to avoid water from pooling outside filtering drain cover 4. Weep holes 23 should be small enough to obstruct the passage of most debris and operate to allow the last remains of water to drain at a slower rate and with less urgency, such as after rainfall has stopped, and the primary task of filtering draining water through the first and second openings 8, 21 has concluded. Depending upon the design of outer cover 5, outer cover 5 may also benefit from similar weep holes (not shown) to perform the same function.

Another embodiment of the invention provides for temporary or permanent attachment of inner filter 11 to outer cover 5 such that relative positioning of inner filter 11 to outer cover 5 is better controlled during installation and in operation. As noted above, a fitted connection between the outer and inner elements permits the user to lift both elements together in a singular movement with the outer cover. The outer cover and inner filter can be temporarily attached, such as with a friction or press fit connection, or with a somewhat more mechanical connection such as shown in FIG. 7.

In FIG. 7, vertical post 25 is formed integrally on the underside of outer cover 5. Vertical post 25 is laterally supported by buttressing ribs 32 and has a terminal lip 33 extending radially outwardly around the bottom portion of post 25. Lip 33 engages internal groove formed below terminal lip 34 in center hub 27 of inner filter 11. The user pushes hub 27 onto post 25 by elastically deforming hub 27 until groove below lip 34 engages lip 33. Vertical guide pin 31 extends downwardly from hub 27 and through one of the passages of the existing drain cover 1 so as to limit lateral displacement of the device if subject to horizontal forces such as wind, flowing liquid, or impacts from the feet of persons walking in close proximity to the device. Pin 31 may be integral to hub 27 (FIG. 7), or outer cover 5 or inner filter 11 (not shown). Pin 31 may further be retractable, temporarily removable, or permanently removable to accommodate application with existing drain cover designs not conducive to receiving the pin function as intended.

There are a multitude of temporary or permanent connection methods that could be used to connect outer cover 5 with inner filter 11. Non-permanent attachment systems permit outer cover 5 to be separated from inner filter 11, preferably without the use of tools, to facilitate cleaning debris from the surfaces and passages.

A center attachment position for the outer cover 5 and inner filter 11 permits the device to create a slanted orientation for filtering surface 29 of the inner filter 11 as shown in FIG. 7. In such an orientation, the slant maintains a gap between filtering surface 29 and drain mounting surface 2 and/or drain plate 1, and thereby may not necessarily depend on ribs 28 to overcome aforementioned flow obstruction due to sagging.

It is understood that the description above is intended to describe preferred embodiments and is not intended to limit the scope of the appended claims.

The invention claimed is:

1. A method for protecting a flush-mounted floor drain that is covered by a flat, perforated, grate from clogging due to leaves, twigs, pebbles and grass clippings that might enter said drain through said flat grate by entirely covering said flat grate and floor drain with an elevated drain cover having two stages of filter openings that allow water to pass but block debris sized greater than the openings, said method further comprising: positioning the elevated drain cover over the entire surface and perimeter of the existing floor drain and onto a support surface surrounding said floor drain, wherein said elevated drain cover comprises:

(a) a first stage comprising an outer cover dimensioned to fit over and entirely cover said flat floor drain grate and rest on said surrounding surface, said outer cover having at least one upstanding perimeter wall capped by a dome-shaped top, each of said perimeter wall and said top having first liquid passage openings of a first size that is sufficient to substantially block passage of solid debris having a dimension larger than said first size, and (b) a second stage comprising an inner, flexible, filter member dimensioned to fit over said flat, floor drain grate and that fits within the upstanding perimeter wall of the first stage and that has second liquid passages of a second size that substantially block passage of solid debris having a dimension smaller than said first size and that has passed through the first liquid passage openings.

2. A method according to claim 1 wherein said inner filter member further comprises a flexible outer rim having a plurality of weep holes around an underside of said rim and the positioning step comprises positioning said elevated drain cover so that said weep holes avoid water from pooling outside said elevated drain cover.

3. A method according to claim 1 wherein said first stage of the elevated drain cover further comprises a centrally-located, vertical post extending downwardly to connect with a centrally-located hub on said second stage so that said inner filter member and said outer cover are mechanically linked together for installation and removal, and said method further comprises positioning said elevated drain cover while said first stage is connected to said second stage.

4. A method according to claim 3 wherein said method further comprises:

removing said first stage from over said flat grate while said second stage is connected to said first stage.

5. A method according to claim 1 wherein said elevated drain cover further comprises a vertical retention pin that extends downwardly from the inner filter member, and said method further comprises positioning said elevated drain cover so that said pin is inserted into an opening of the flat grate and holds the elevated drain grate cover in place against dislodging forces.

6. A method for protecting a flat, round, floor drain opening having a perimeter that is covered by a flat, perforated, grate over said drain that has been installed substantially flush with a support surface surrounding said drain by steps that comprise:

covering said drain and flat grate with an elevated drain cover that is supported by the support surface surrounding said drain, said elevated drain cover having two stages of debris filtration that comprise:

(a) a first stage comprising an outer cover dimensioned to fit over and entirely enclose said flat floor drain grate and rest on said surrounding surface, said outer cover having at least one upstanding perimeter wall capped by a dome-shaped top, each of said perimeter wall and said top having first liquid passage openings of a first size that is sufficient to substantially block passage of solid debris having a dimension larger than said first size, and (b) a second stage comprising an inner, flexible, filter member dimensioned to fit entirely over said flat, floor drain grate and that fits within the upstanding perimeter wall of the first stage and that has second liquid passages of a second size that substantially block passage of solid debris having a dimension smaller than said first size and that has passed through the first liquid passage openings, said inner filter member further comprising a vertical retention pin that extends downwardly from the inner filter member, and said method further comprises positioning said elevated drain cover so that said pin is inserted into an opening of the flat grate and holds the elevated drain grate cover in place against dislodging forces.

7. A method according to claim 6 wherein said inner filter member further comprises a flexible outer rim having a plurality of weep holes around an underside of said rim and the positioning step comprises positioning said elevated drain cover so that said weep holes avoid water from pooling outside said elevated drain cover.

8. A method according to claim 6 wherein said first stage of the elevated drain cover further comprises a centrally-located, vertical post extending downwardly to connect with a centrally-located hub on said second stage so that said inner filter member and said outer cover are mechanically linked together for installation and removal, and said method further comprises positioning said elevated drain cover while said first stage is connected to said second stage.

9. A method according to claim 8 wherein said method further comprises:

removing said first stage from over said flat grate while said second stage is connected to said first stage.

10. In combination, a flat, floor drain grate over a drain pipe set into a support surface that surrounds said drain pipe and is substantially parallel and flush with said flat drain grate, and an elevated, two stage, floor drain grate cover that is configured to fit over and surround said flat floor drain grate so as to obstruct flow of debris to said flat, floor drain, grate with openings that allow water to pass but which hinder debris, wherein said elevated grate cover extends above and into contact with said surrounding support surface, and is dimensioned to be at least as large as the flat floor drain grate such that the flat floor drain grate is fully enclosed within the area of contact between said cover and said surrounding surface, and wherein said elevated grate cover comprises two stages of filters for debris draining towards said drain, said elevated grate cover comprising:

(a) a first stage comprising an outer cover dimensioned to fit over and entirely enclose said flat floor drain grate and rest on said surrounding surface, said outer cover having at least one upstanding perimeter wall capped by a dome-shaped top, each of said perimeter wall and said top having first liquid passage openings of a first size that is sufficient to substantially block passage of solid debris having a dimension larger than said first size, and (b) a second stage comprising an inner, flexible, filter member dimensioned to fit entirely over said flat, floor drain grate and that fits within the upstanding perimeter wall of the first stage and that has second liquid passages of a second size that substantially block passage of solid debris having a dimension smaller than said first size and that has passed through the first liquid passage openings.

11. The combination of claim 10 wherein said inner filter member further comprises a flexible outer rim having a plurality of weep holes around an underside of said rim.

12. The combination of claim 10 wherein said outer cover of said elevated grate cover further comprises a centrally-located, vertical post extending downwardly to connect with a centrally-located hub on said inner filter member so that said inner filter member and said outer cover are mechanically linked together for installation and removal.

13. The combination of claim 12 wherein said centrally-located, vertical post comprises an external lip at a terminal end thereof that engages an internal groove in said center hub by elastically deforming said center hub until said internal groove engages the external lip.

14. The combination of claim 13 wherein a vertical guide pin extends downwardly from the center hub of the inner filter of appropriate length and size to pass through an opening in said flat floor drain grate.

15. The combination of claim 10 wherein said inner filter member fits within said outer cover with a frictional fit therebetween.

16. The combination of claim 10 wherein said inner filter member fits within said outer cover with a mechanical connection therebetween.

17. The combination according to claim 10 wherein said inner filter member further comprises radially extending supporting ribs that hold said inner filter member away from said flat, floor drain grate and said surrounding surface.

18. The combination according to claim 10 wherein the inner filter element further comprises a vertical retention pin that extends downwardly from the inner filter member so that, when positioned over said drain, said pin extends into an opening of the flat grate.

* * * * *